United States Patent [19]

Ishikawa et al.

[11] Patent Number: 4,787,353

[45] Date of Patent: Nov. 29, 1988

[54] THROTTLE VALVE CONTROL APPARATUS FOR AN INTERNAL COMBUSTION ENGINE MOUNTED ON A VEHICLE

[75] Inventors: Yoshikazu Ishikawa; Kouji Yamaguchi, both of Wako, Japan

[73] Assignee: Honda Giken Kogyo Kabushiki Kaisha, Tokyo, Japan

[21] Appl. No.: 100,065

[22] Filed: Sep. 23, 1987

[30] Foreign Application Priority Data

Sep. 24, 1986 [JP] Japan ..... 61-226536
Sep. 24, 1986 [JP] Japan ..... 61-226538

[51] Int. Cl.[4] ..... F02D 11/10
[52] U.S. Cl. ..... 123/399; 123/400
[58] Field of Search ..... 123/339, 361, 399, 400

[56] References Cited

U.S. PATENT DOCUMENTS 4,453,516 6/1984 Filsinger ..... 123/340
4,508,078 4/1985 Takeuchi et al. ..... 123/399
4,660,520 4/1987 Inoue et al. ..... 123/399

FOREIGN PATENT DOCUMENTS 164630 8/1985 Japan .

*Primary Examiner*—Tony M. Argenbright
*Attorney, Agent, or Firm*—Pollock, VandeSande and Priddy

[57] ABSTRACT

A throttle valve control apparatus for an internal combustion engine uses a target throttle valve opening which is selected between one of a first opening valve determined according to the operation position of the accelerator pedal and a second opening value smaller than the first opening value. When the target throttle valve opening is switched from the second opening value to the first opening value, the driving speed of the throttle valve by a drive mechanism of the apparatus is controlled so as to maintain smooth operation of the engine.

4 Claims, 7 Drawing Sheets

THROTTLE VALVE CONTROL APPARATUS FOR AN INTERNAL COMBUSTION ENGINE MOUNTED ON A VEHICLE

BACKGROUND OF THE INVENTION

1. Field of the Invention

The present invention relates to a throttle valve control apparatus for an internal combustion engine mounted on a vehicle.

2. Description of Background Information

As an example of throttle valve control apparatus, there is a known arrangement in which an operation position of a throttle valve is detected and the throttle valve is driven according to an opening characteristic which is previously determined correspondingly to the detected operation position, such as an apparatus disclosed in Japanese patent application laid open No. P 60-164630.

On the other hand, there have been continuous studies on the control of throttle valve opening in order to minimize the fuel consumption of an internal combustion engine. For example, an apparatus is proposed by the present applicant, in which a target opening of a throttle valve at which the minimum fuel consumption rate (BSFC) is obtained is established in connection with the rotational speed of the engine, and the throttle valve is driven by means of a motor for example in a manner to reduce the deviation of an actual throttle valve opening from the target throttle valve opening. However, with such a throttle valve control operation, the output power of the engine may become insufficient in a power requiring range of engine operation such as an accelerating state in which the generation of high engine output power is preferable to the fuel economy, thus deteriorating the driveability of the engine. Moreover, if the apparatus is designed to switch the control mode of the throttle valve upon transition of the engine operation from an economical driving requiring range to the power requiring range, a rapid increase of the throttle valve opening may occur, to generate a shock. Thus, a smooth transition of the engine operation may not be possible.

OBJECT AND SUMMARY OF THE INVENTION

An object of the present invention is therefore to provide a throttle valve control apparatus for an internal combustion engine, which apparatus is capable of attaining a sufficiently small fuel consumption rate during engine operations in the economical driving requiring range and ensuring the good driveability of the engine during engine operations in the power requiring range, and capable of preventing the generation of a shock and enabling a smooth transition of the engine operation from the economical driving requiring range to the power requiring range.

According to the present invention, a throttle valve control apparatus for an internal combustion engine has a target throttle valve opening toward which the throttle valve is driven, which target throttle valve opening is selected between a first opening value which is proportional to an operation position (degree of the depression) of an accelerator pedal and a second opening value which is smaller than the first opening value in accordance with operating conditions of the engine. The apparatus limits a driving speed of the throttle valve to be lower than a given slow speed value upon switching of the target throttle valve opening from the second opening value to the first opening value.

According to another aspect of the present invention, a throttle valve control apparatus for an internal combustion engine has a target throttle valve opening toward which the throttle valve is driven, which target throttle valve opening is selected between a first opening value which is proportional to an operation position (degree of the depression) of an accelerator pedal and a second opening value which is smaller than the first opening value in accordance with operating conditions of the engine. After a switching of the target throttle valve opening from the second opening value to the first opening value, the driving of the throttle valve is enabled only when the operation position of the accelerator pedal is changed in a depressing direction.

DETAILED DESCRIPTION OF THE PREFERRED EMBODIMENTS

Figure 1:
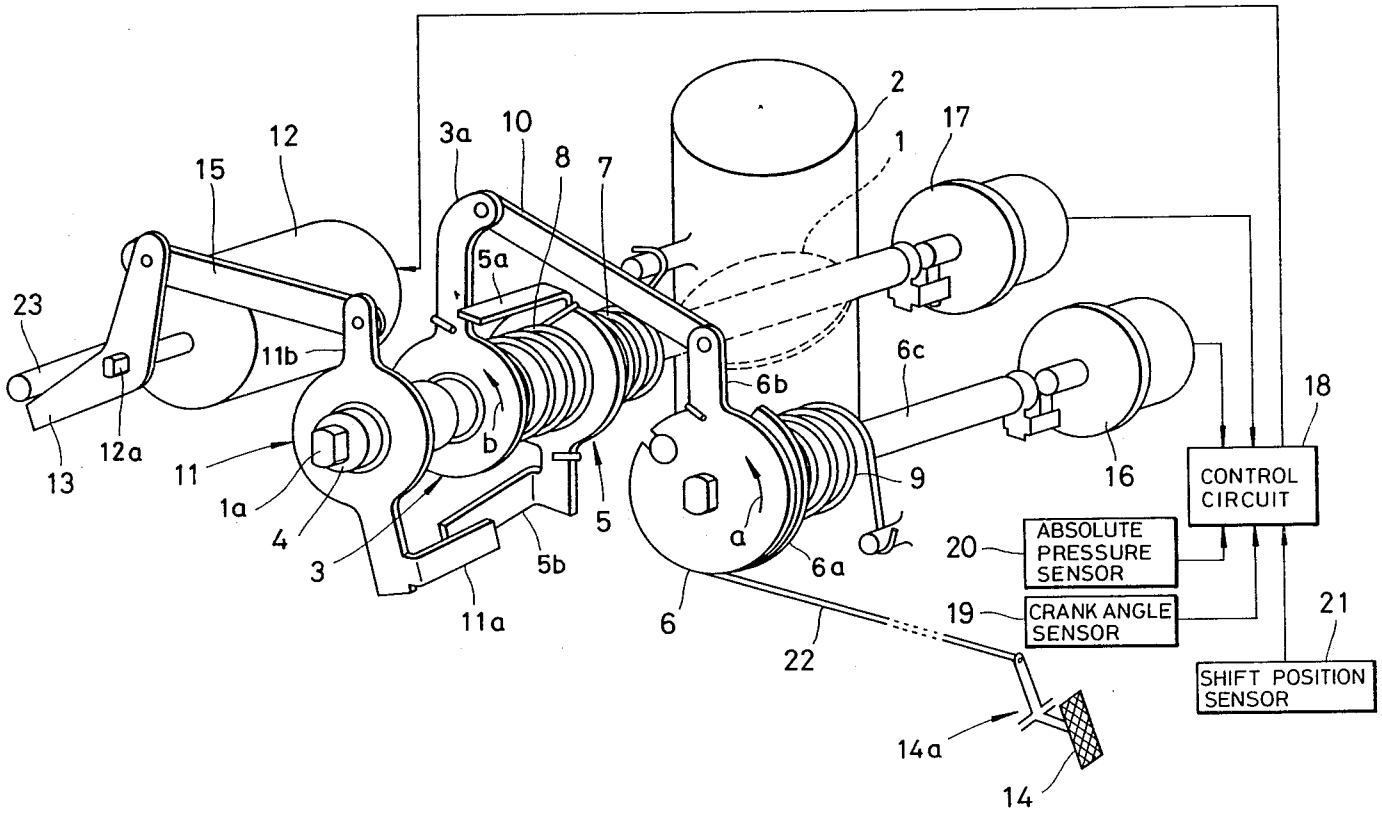
FIG. 1 is a schematic diagram showing an embodiment of a throttle valve control apparatus according to the present invention.

Preferred embodiments of the present invention will be explained hereinafter with reference to the accompanying drawings, in which FIG. 1 is a schematic diagram showing the construction of the throttle valve control apparatus according to the present invention.

As shown, a shaft 1*a* of a throttle valve 1 is extended to the outside of an intake pipe 2 of an engine. On the extended part of the shaft 1*a*, a throttle drum 3 is mounted via a free collar 4 which is inserted into its center hole, so that the throttle drum 3 is freely rotatable on the shaft 1*a*. A throttle direct connection lever 5 is fixed on the shaft 1*a*. The throttle drum 3 is provided with an abutting lever 3*a* which radially projects from the throttle drum 3. The throttle direct connection lever 5 has an abutting arm 5*a* and an engaging arm 5*b* symmetrically about its axis of rotation. The throttle direct connection lever 5 is biased by means of a return spring 7 to rotate in a direction to close the throttle valve 1. Furthermore, the throttle drum 3 and the throttle direct connection lever 5 are biased by means of a lost motion spring 8 provided between them to cause an abutment between the abutting lever 3*a* and the abutting arm 5*a*.

An acceleration drum 6 is mounted on an acceleration drum shaft 6*c*. The acceleration drum 6 is provided with a wire guide groove 6a formed continuously around its periphery, and a throttle wire 22 having an end connected to the acceleration drum 6 is wound around the wire guide groove 6a. The other end of the throttle wire 22 is connected to a link mechanism 14a of an accelerator pedal 14. With this link mechanism 14a, the throttle wire 6 is pulled toward the accelerator pedal 14 to cause the rotation of the acceleration drum 6 in a direction indicated by the arrow a in proportion to the degree of depression of the accelerator pedal 14. Also, the acceleration drum 6 is biased by means of a return spring 9, in an opposite direction with respect to the arrow a. A connecting projection 6a provided on the acceleration drum 6 is connected to the abutting lever 3a of the throttle drum 3 by means of an elongated connection member 10, to cause a rotating movement of the throttle drum 3. With the mechanism described above, the opening degree of the throttle valve 1 is varied in proportion to the degree of depression of the accelerator pedal 14.

In addition, on an extremity of the extended part of the shaft 1a, a throttle closing lever 11 is mounted via the free collar 4 so that it can rotate freely on the shaft 1a. An end of the throttle closing lever 11 forms a stopper arm 11a which is contactable to the engaging arm 5b so as to limit the opening of the throttle valve 1, and the other end of the throttle closing lever 11 forms a connection projection 11b. The throttle closing lever 11 is driven by a pulse motor 12 by means of the following mechanism. A shaft 12a of the pulse motor 12 is connected to a central part of a motor lever 13 having a doglegged shape, and an end of the motor lever 13 is connected to the connection projection 11b of the throttle closing lever 11 via a connection rod 15, to generate a rotational motion of the throttle closing lever 11. This end of the motor lever 13 is contactable, by abutment, to a motor stopper 23 to prevent a forward rotation of the pulse motor 12 exceeding a predetermined angle from a reference angular position. The other end of the motor lever 13 is also contactable, by abutment, to the motor stopper 23 to prevent the rotation of the pulse motor 12 in the reverse direction from the reference angular position. An acceleration pedal operation position sensor 16 which includes a potentiometer for example is connected to the acceleration drum shaft 6c. The acceleration pedal operation position sensor 16 produces an output voltage which corresponds to the operation position of the acceleration pedal 14, that is, an angle of rotation from an idling position about the acceleration drum shaft 6c as its axis of rotation.

A throttle opening sensor 17 which also includes a potentiometer for example is connected to the shaft 1a of the throttle valve 1. The throttle opening sensor 17 produces an output voltage corresponding to the opening degree of the throttle valve 1.

The accelerator pedal operation position sensor 16, the throttle opening sensor 17, and the pulse motor 12 are connected to a control circuit 18. To the control circuit 18 is also connected a crank angle sensor 19 which generates a pulse signal at a predetermined angular position of a crankshaft of the engine (not shown) as the crankshaft rotates, an absolute pressure sensor 20 for generating an output signal which represents an absolute pressure in the intake pipe 2 downstream of the throttle valve 1, and a shift position sensor 21 for sensing the shift position of a five-speed (forward direction) manual transmission of the vehicle. The shift position sensor 21 generates a binary coded digital signal corresponding to the shift position, for example, by means of a plurality of switches arranged to be interlocked with a shift lever of the transmission, and to be switched on to produce a high level output signal.

Figure 2:
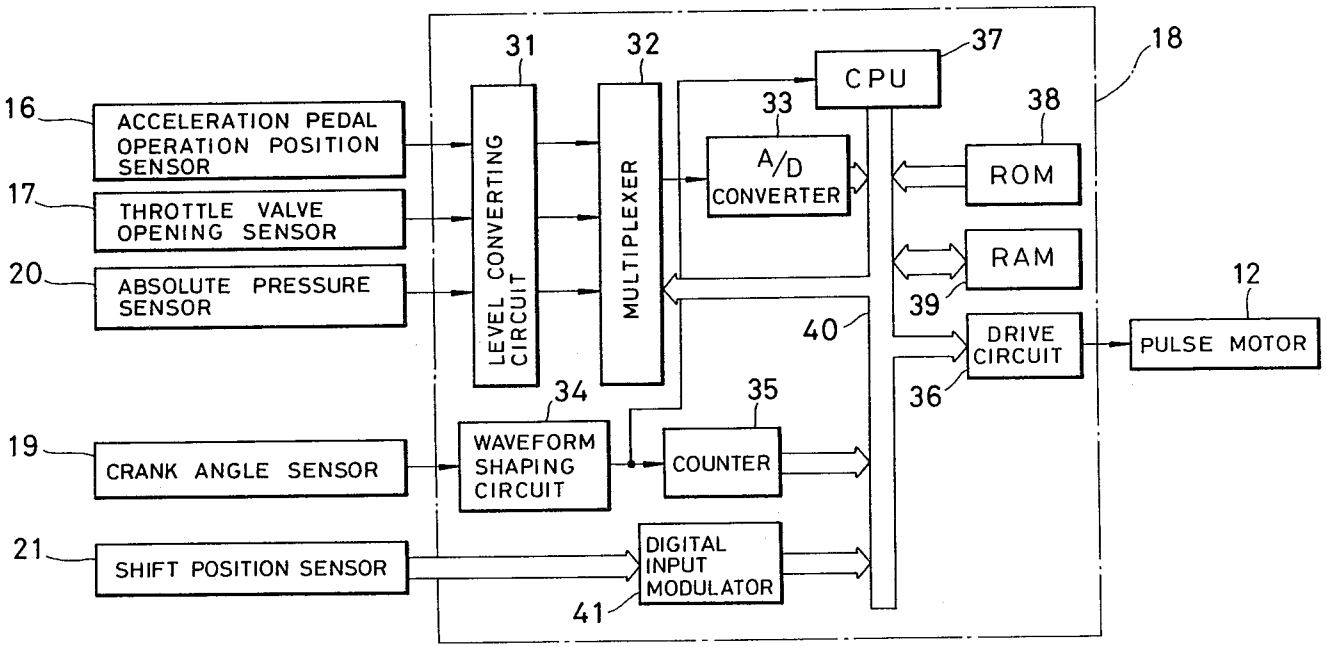
FIG. 2 is a block diagram showing the concrete structure of a control circuit used in the apparatus shown in FIG. 1.

As shown in FIG. 2, the control circuit 18 includes a level converting circuit 31 for the level conversion of respective output signals of the accelerator pedal operation position sensor 16, the throttle valve operating position sensor 17, and the absolute pressure sensor 20, a multiplexer 32 for selectively transmitting one of the voltage signals supplied from the level converting circuit 31, an A/D converter 33 for analog to digital conversion of an output signal of the multiplexer 32, a waveform shaping circuit 34 for waveform shaping the output signal of the crank angle sensor 19, a counter 35 for measuring the interval of TDC signals which are produced as pulse signals by the waveform shaping circuit 34, by counting clock pulses supplied from a clock pulse generating circuit (not shown), a digital input modulator 41 which comprises a decoder for digital code translation of the output signal of the shift position sensor 21, a drive circuit 36 for driving the pulse motor 12, a CPU (central processing unit) 37 for performing digital operations in accordance with programs, a ROM 38 in which the programs and data are stored previously, and a RAM 39. The multiplexer 32, the A/D converter 33, the counter 35, the drive circuit 36, the CPU 37, the ROM 38, the RAM 39, and the digital input modulator 41 are mutually connected by means of a bus 40. Furthermore, a clock pulse signal from a clock signal generating circuit which is not illustrated is supplied to the CPU 37, and the TDC signals are also supplied to the CPU 37 from the waveform shaping circuit 34. The CPU 37 and the ROM 38 operate as setting means, and the drive circuit 36 and the drive mechanism shown in FIG. 1 operate as drive means.

With this arrangement, information regarding the accelerator pedal angle (operation position) $\theta_{ACC}$, the throttle valve opening angle $\theta$th, and the absolute intake manifold pressure $P_{BA}$ (absolute pressure in the intake pipe 2) selectively from the A/D converter 23 as well as information as to the rotational speed of the engine from the counter 35 and the shift position from the digital input modulator 41, is supplied to the CPU 37 through the bus 40. The CPU 37 reads in the above information in accordance with the operation program stored in the ROM 38, in synchronism with the clock pulse signal. By the processing operation which will be explained later, the CPU 37 generates a pulse motor valve open drive command and a pulse motor valve close drive command for driving the pulse motor 12, and a pulse motor drive stop command for stopping the drive of the pulse motor 12, and supplies the commands to the drive circuit 36.

Figure 3:
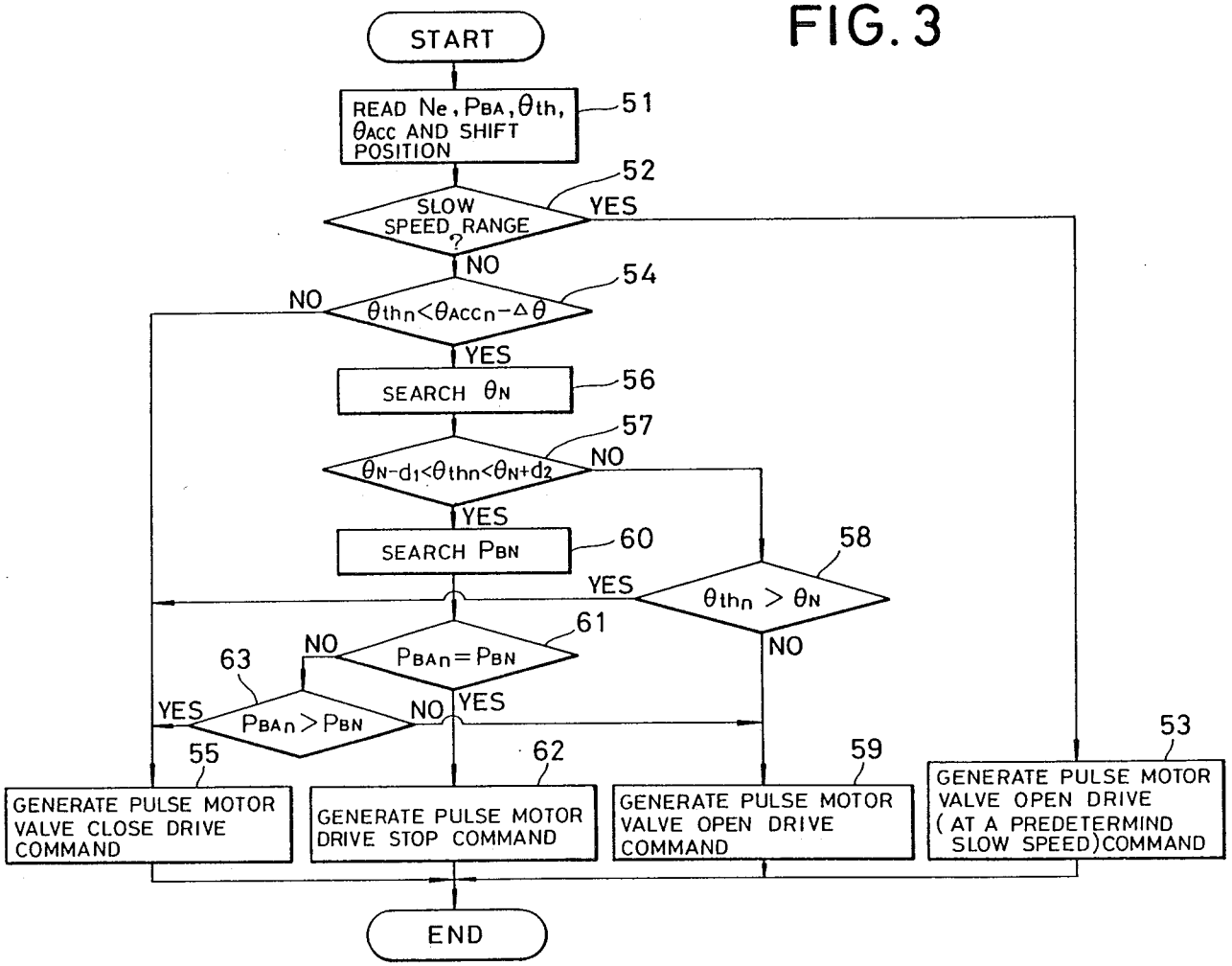
FIG. 3 is a flowchart showing the operation of a CPU 37 provided in the control circuit of FIG. 2.

The operation of a first embodiment of the throttle valve control apparatus having the above explained construction will be explained with reference to the operation flowchart of the CPU 37 shown in FIG. 3.

At predetermined intervals, the CPU 37 reads the engine rotational speed Ne, the absolute intake manifold pressure $P_{BA}$, the throttle valve opening $\theta$th, the accelerator pedal angle $\theta_{ACC}$ and the shift position at a step 51. Then the CPU 37 determines whether or not the shift position of the transmission is in a slow speed range (first and second speeds) at a step 52. When the shift position of the transmission gear is in the slow speed range, a pulse motor valve drive command including information of the drive speed $\Delta\theta$th which is equal to a value $\Delta\theta$thL is generated and supplied to the drive circuit 36 at a step 53 in order to control the opening $\theta$th of the throttle valve which is proportional to the accelerator pedal angle $\theta_{ACC}$.

Figure 4:
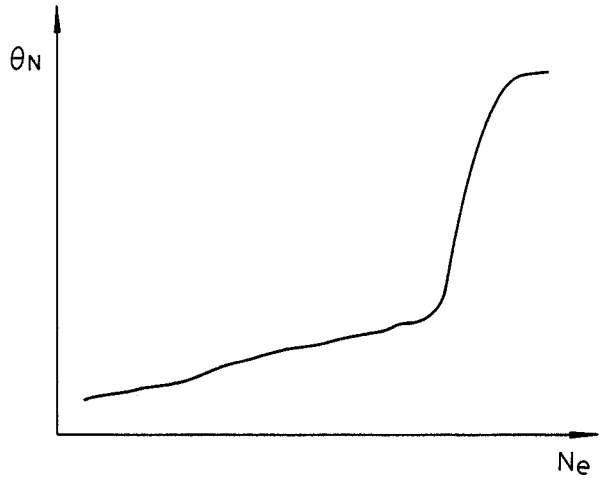
FIG. 4 is a diagram showing the characteristic of a $\theta_N$ data table which is previously stored in a ROM 38 of the control circuit of FIG. 2.
Figure 5:
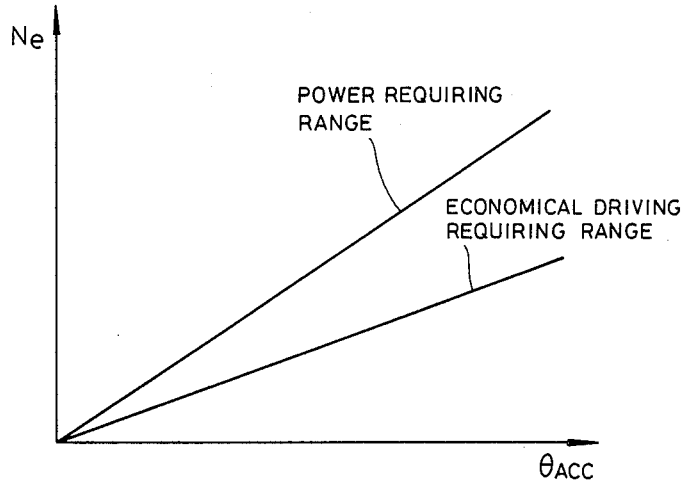
FIG. 5 is a diagram showing the relation between accelerator pedal angle $\theta_{Acc}$ and rotational speed Ne of the engine.

On the other hand, if the shift position is detected not to be in the slow speed range at the step 52, (which means that the shift position is any one of third to fifth speeds), it is then regarded that the engine operation is in an economical driving requiring range, and the CPU 37 determines whether or not a read value $\theta th_n$ of the throttle valve opening $\theta$th is smaller than a value which is obtained by subtracting a predetermined value $\Delta\theta$ (0.5° for example) from the accelerator pedal angle $\theta_{ACCn}$, at a step 54. If $\theta th_n \geqq \theta_{ACCn} - \Delta\theta$, it means that the throttle valve opening $\theta th_n$ is large, the CPU 37 generates a pulse motor valve open drive command including information of drive speed $\Delta\theta$th which is equal to a value $\Delta\theta$thH ($\Delta\theta thH > \Delta\theta thL$) and supplies it to the drive circuit 36, at a step 55. On the other hand, if $\theta th_n < \theta_{ACCn} - \Delta\theta$, the CPU 37 searches a target throttle valve opening $\theta_N$ at which the BSFC can be attained from the ROM 37 in accordance with a read value $Ne_n$ of the engine rotational speed Ne at a step 56. In the ROM 38, various values of the target throttle valve opening are previously stored correspondingly to values of the engine rotational speed Ne in the form of a $\theta_N$ data table as shown by the characteristic shown in FIG. 4, and the target value $\theta_N$ corresponding to the read value $Ne_n$ of the engine rotational speed is searched from the $\theta_N$ data table. In addition, also in such systems as CVT (continuously variable transmission) systems, the relation between the engine rotational speed Ne and the accelerator pedal angle $\theta_{Acc}$ is determined differently for the economical driving requiring range and for the power requiring range, as illustrated in FIG. 5. Then the CPU 37 determines whether or not the throttle valve opening $\theta$thn is greater than a value which is obtained by subtracting a tolerance value $d_1$ from the target throttle valve opening $\theta_N$ and at the same time smaller than a value which is obtained by adding a tolerance value $d_2$ to the target throttle valve opening $\theta_N$ at a step 57. If $\theta th_n < \theta_N - d_1$ or $\theta th_n > \theta_n + d_2$, it means that the actual throttle valve opening $\theta$thn is outside a tolerance range of the target throttle valve opening at which the BSFC is obtained in connection with the engine rotational speed Ne. Therefore, the CPU 37 determines whether or not the actual throttle valve opening $\theta$thn is greater than the target throttle valve opening $\theta_N$ at a step 58. If $\theta th_n > \theta_N$, then the CPU 37 executes the operation of the step 55 to supply the pulse motor valve close drive command including the information of the drive speed $\Delta\theta$th equal to the value $\Delta\theta$thH to the drive circuit 36 so as to drive the throttle valve 1 in a closing direction. If $\theta th_n \leqq \theta_N$, $\theta_N$, the CPU 37 supplies a pulse motor valve open drive command including the information of the drive speed $\Delta\theta$th equal to the value $\Delta\theta$thH to the drive circuit 36 at a step 59.

Figure 6:
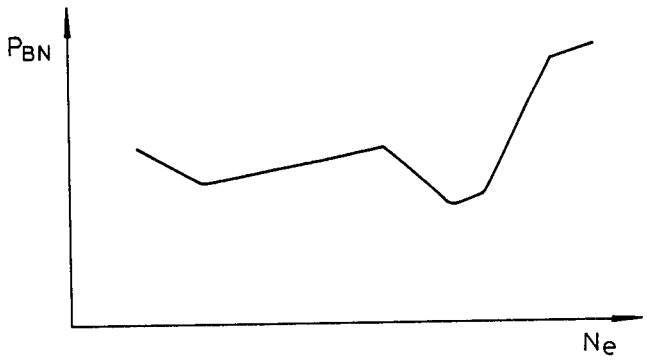
FIG. 6 is a diagram showing the characteristic of a $P_{BN}$ data table which is previously stored in the ROM 38 of the control circuit shown in FIG. 2.

On the other hand, if $\theta_N - d_1 < \theta th_n < \theta_N + d_2$, the CPU 37 searches from the ROM 38 a target absolute pressure $P_{BN}$ in the intake pipe at which the BSFC is attained in connection with read value $Ne_n$ of the engine rotational speed Ne at a step 60. In the ROM 38, various values of the target absolute pressure $P_{BN}$ are previously stored correspondingly to values of the engine rotational speed Ne as a $P_{BN}$ data table in the manner as illustrated in FIG. 6. Therefore, the CPU 37 searches a value of the target absolute pressure $P_{BN}$ corresponding to a read value $Ne_n$ of the engine rotational speed from the $P_{BN}$ data table. Subsequently, the CPU 37 determines whether or not the detected absolute pressure $P_{BAn}$ in the intake pipe is equal to the target absolute pressure $P_{BN}$ at a step 61. If $P_{BAn} = P_{BN}$, then the CPU 37 generates a pulse motor drive stop command and supplies it to the drive circuit 36 at a step 62 in order to maintain the throttle valve opening at that time. If $P_{BAn} \neq P_{BN}$, then the CPU 37 determines whether or not the absolute pressure $P_{BA}n$ in the intake pipe is greater than the target absolute pressure $P_{BN}$ at a step 63. If $P_{BAn} > P_{BN}$, the CPU 37 executes the operation of the step 55 to supply the pulse motor valve close drive command including the information of the drive speed $\Delta\theta$th equal to the speed value of $\Delta\theta$thH in order to drive the throttle valve in the closing direction. If $P_{BAn} < P_{BN}$, the CPU 37 executes the operation of the step 59 to supply the pulse motor valve open drive command including the information of the drive speed $\Delta\theta$thH which is equal to the speed value of $\Delta\theta$thH to the drive circuit 36 in order to drive the throttle valve in the opening direction.

The pulse motor valve open drive command and the pulse motor valve close drive command both of which include the information of drive speed $\Delta\theta$th, are formed, for example, as a 8 bit digital signal; 2 bits thereof indicate the drive/stop order and the drive direction, and the remaining 6 bits thereof indicate the drive speed $\Delta\theta$th. The drive circuit 36 may, for example, be constructed to include a frequency synthesizer PLL circuit for generating an oscillation signal having a frequency corresponding to the information of the drive speed $\Delta\theta$th, a waveform shaping circuit for converting the oscillation signal into a pulse signal, and a logic circuit for controlling (supplying and stopping) the pulse train signal to the pulse motor 12. Also, the drive circuit 36 may be constructed as a frequency divider for frequency dividing a clock signal at a dividing rate corresponding to the information of the drive speed $\Delta\theta$th.

In response to the pulse motor valve open drive command, the drive circuit 36 supplies first drive pulses to the pulse motor 12 so as to drive the pulse motor 12 in the forward direction with the interval of generation of the first drive pulses corresponding to the drive speed $\Delta\theta$th. Thus, the throttle closing lever 11 is rotated in the direction indicated by the arrow b in FIG. 1. On the other hand, in response to the pulse motor valve close drive command, the drive circuit 36 supplies second drive pulses which are opposite in phase to the first drive pulses, to the pulse motor 12 so as to drive the pulse motor 12 in the reverse direction, with the interval of generation of the second pulses corresponding to the drive speed $\Delta\theta$th. Thus, the throttle closing lever 11 is rotated in a direction which is opposite to the direction of the arrow b.

If the accelerator pedal 14 is depressed when the rotation angle of the pulse motor 12 is in the forward direction from the reference angular position, the throttle wire 22 is pulled toward the accelerator pedal 14, to cause rotation of the acceleration drum 6 in the direction indicated by the arrow a, and the rotation of the throttle drum 3 which is linked with the acceleration drum 6 in the direction indicated by the arrow b at the same time. By the biasing force of the lost motion spring 8, the throttle direct connection lever is also rotated in the direction indicated by the arrow b, with the abutting arm 5*a* contacting with the abutting lever 3*a*. Therefore, the throttle valve 1 is moved in the opening direction so that its opening angle is equal to the accelerator pedal angle $\theta_{ACC}$.

Thus, when the shift position of the transmission gear is in the slow speed range, the pulse motor valve open drive command is generated and the throttle valve opening angle $\theta$th is controlled with the accelerator pedal angle $\theta_{ACC}$, i.e., the first opening value as the target throttle valve opening.

If the shift position of the transmission gear is not in the slow speed range, the engaging arm 5*b* comes to abut to the stopper arm 11*a* which is positioned by the pulse motor 12 as the accelerator pedal 14 is depressed. Accordingly, the throttle valve 1 stops at this position, and the throttle drum 3 is rotated in the direction of the arrow b with the abutting lever 3*a* being moved away from the abutting arm 5*a*.

When the pulse motor 12 is rotated in the reverse direction, the stopper arm 11*a* comes to abut to the engaging arm 5*b*, to cause the rotation of the throttle direct connection lever 5 in the direction reverse to the direction indicated by the arrow b. Therefore, the throttle valve 1 is driven in the closing direction irrespectively of the accelerator pedal angle $\theta_{ACC}$.

In response to the pulse motor drive stop command, the rotation of the pulse motor 12 is stopped to maintain the throttle valve opening under that condition. Therefore, when the shift position of the transmission gear is any one of the third to fifth speeds, the throttle valve 1 is driven so that the actual throttle valve opening $\theta$th is reduced from the accelerator pedal angle $\theta_{ACC}$, and it becomes equal to the target throttle valve opening $\theta_N$ (second opening value). Under this condition, if the actual throttle valve opening $\theta$th is in the tolerance range of the target throttle valve opening, the throttle valve 1 is driven so that the absolute pressure $P_{BA}$ in the intake pipe becomes equal to the target absolute pressure $P_{BN}$.

If $\theta th_n \geqq \theta_{ACCn} - \Delta\theta$, the pulse motor valve close drive command is generated, and the pulse motor 12 is rotated in the reverse direction, to rotate the throttle closing lever 11 in the direction which is opposite to the direction of the arrow b. However, under this condition, the acceleration drum 6 is rotated in the direction opposite to the direction of the arrow a because of the biasing force of the return spring 9. At the same time, the throttle drum 3 linked with the acceleration drum 6 is rotated in the direction opposite to the direction of the arrow b. Since the speed of rotation of the throttle drum 3 under this condition is faster than the speed of rotation of the throttle closing lever 11 driven by the pulse motor 12, the rotational motion of the throttle closing lever 11 is transmitted through the throttle direct connection lever 5, to move the throttle valve 1 in the closing direction. Therefore, the throttle valve 1 is mechanically driven in the closing direction by means of the biasing force of the return spring 9.

On the other hand, when the driving condition is switched from the economical driving requiring range to the power requiring range, the throttle closing lever 11 is driven in the direction of the arrow b at a driving speed equal to the slow speed $\Delta\theta$thL, and the throttle valve 1 is driven at the slow speed $\Delta\theta$thL until the abutting arm 5*a* comes to abut to the abutting lever 3*a* even if the accelerator pedal 14 is depressed rapidly and deeply. After that, the pulse motor 12 is still driven until the position of the motor lever 13 is restricted by the motor stopper 23.

Thus, in the above explained first embodiment of the throttle valve control apparatus for a vehicle mounted internal combustion engine according to the present invention, one of the first opening value which is proportional to the operation position of the accelerator pedal and the second opening value which is smaller than the first opening value is selected as a target throttle valve opening in accordance with the operating condition of the engine, and the throttle valve is driven so that its opening becomes equal to the target throttle valve opening. Therefore, by setting the first opening value as the target valve opening in the power requiring range and setting the second opening value as the target throttle valve opening in the economical driving requiring range, it is possible to prevent a condition wherein the engine output power becomes insufficient in the power requiring range. Thus a good driveability of the engine is obtained. Upon switching of the target throttle valve opening from the second opening value to the first opening value, the speed of the opening of the throttle valve is limited to be lower than a predetermined slow speed. Therefore, a sudden increase of the opening degree of the throttle valve upon switching from the economical driving requiring range to the power requiring range is prevented, and the shock generated in connection with such a switching is minimized.

Referring to the flowchart of FIG. 7 the operation of a second embodiment of the throttle valve control apparatus according to the present invention will be explained.

Since the operation of the second embodiment includes steps the same as those of the first embodiment which have been already explained with reference to FIG. 3, the explanation of those steps will not be repeated.

Figure 7:
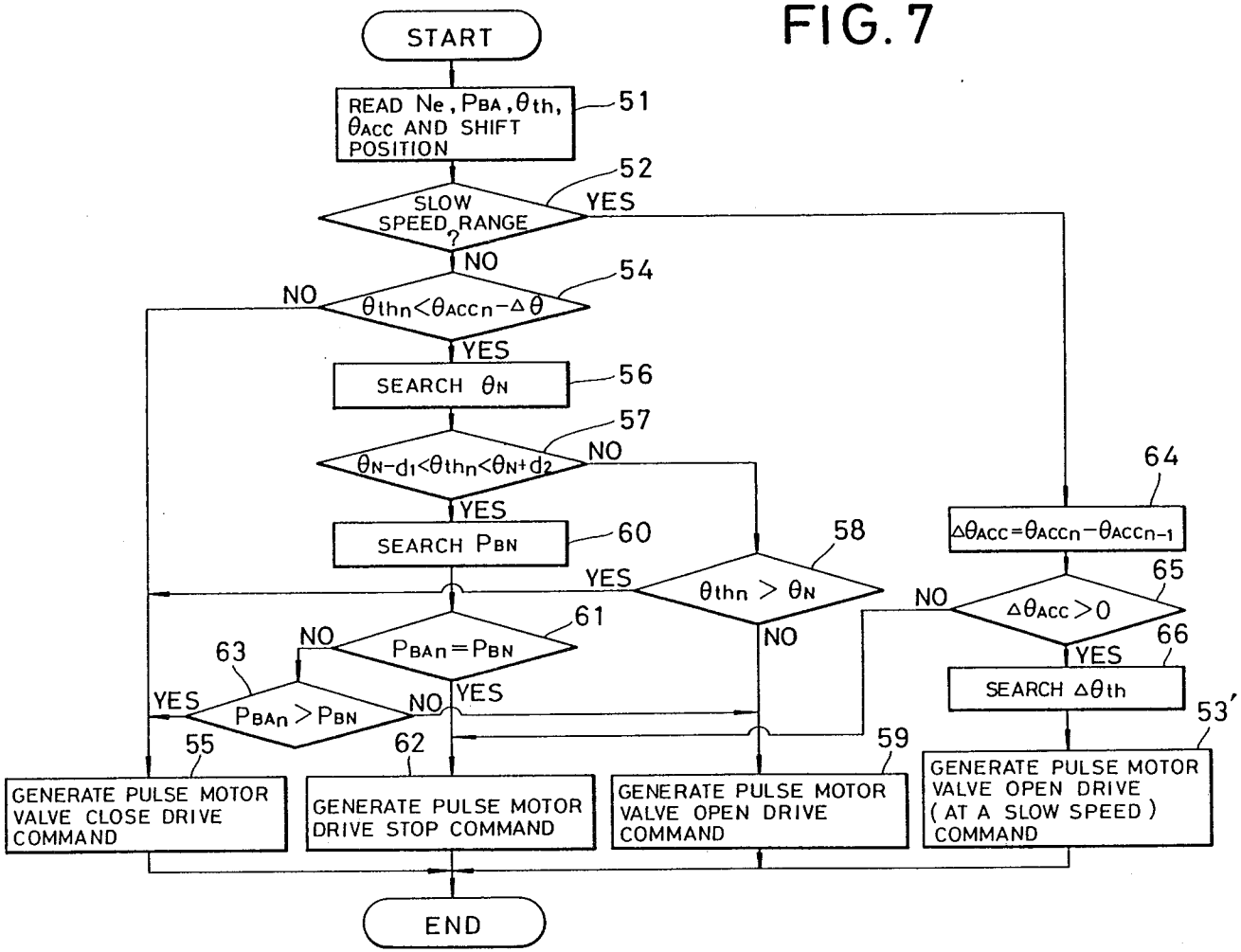
FIG. 7 is a flowchart showing the operation of the CPU 37 in a second embodiment of the invention.
Figure 8:
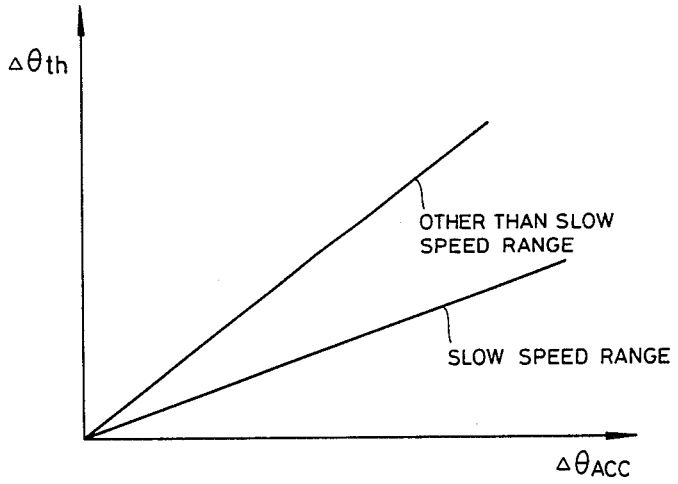
FIG. 8 is a diagram showing the characteristic of a $\Delta\theta$th data table previously stored in the ROM 38 of the control circuit.

In FIG. 7, if the shift position is detected to be in the slow speed range at the step 52, it is then regarded that the engine operation is in the power requiring range, and the program goes to a step 64 at which determines a change amount $\Delta_{ACC}$ between a presently read value $\theta_{ACCn}$ of the acceleration pedal angle and a preceding accelerator pedal angle $\theta_{ACCn-1}$ which has been read at the previous time. Subsequently, whether or not the change amount $\Delta_{ACC}$ is greater than 0 (zero) is detected at a step 65. If $\theta_{ACC} \leqq \theta$, the pulse motor drive stop command is generated by the CPU 37 and supplied to the drive circuit 36 at a step 62 so as to maintain the opening of the throttle valve at that time. If $\Delta\theta_{ACC} > 0$, it means that the accelerator pedal 14 is being depressed, and the CPU 37 searches a value of the drive speed $\Delta\theta$th from a $\Delta\theta$th data table previously stored in the ROM 38 at a step 66. FIG. 8 shows the characteristic of the $\Delta\theta$th data table. Then the program proceeds to a step 53' at which a pulse motor valve open drive command including the information of drive speed $\Delta\theta$th which has been searched out at the step 66 is supplied to the drive circuit 36.

In this embodiment, the operations of the steps 55 and 59 are the same as those of the previous embodiment. However, it is to be noted that the pulse motor valve close drive command and the pulse motor valve open drive command generated in these steps carry simply information of the driving speed $\Delta\theta$th.

In this slow speed range, the engine operation is in the power requiring range. Therefore, if the accelerator pedal 14 is being depressed, the throttle valve opening drive speed $\Delta\theta$th is set in response to the speed of change in the accelerator pedal angle $\theta_{ACC}$ so as to drive the throttle valve 1 in the opening direction. As shown in FIG. 1, the throttle closing lever 11 is rotated in the direction of the arrow b by means of the pulse motor 12 at the designated drive speed $\Delta\theta$th. Since the engaging arm 5*b* comes to abut to the stopper arm 11*a* of f the throttle closing lever 11 by means of the biasing force of the lost motion spring 8, the throttle valve 1 is driven in the opening direction at a designated drive speed $\Delta\theta$th. This value of drive speed $\Delta\theta$th in the slow speed range is smaller than the values of the drive speed $\Delta\theta$th under driving conditions other than the slow speed range. Those values of the drive speed $\Delta\theta$th under driving conditions other than the slow speed range are set according to other operational parameters as well as the change amount $\Delta\theta_{ACC}$ of the accelerator pedal angle. However, as shown in FIG. 8, those values are set to be higher than the values of the drive speed $\Delta\theta$th in the slow speed range.

Thus, also in the above explained second embodiment of the throttle valve control apparatus for a vehicle mounted internal combustion engine according to the present invention, one of the first opening value which is proportional to the operation position of the accelerator pedal and the second opening value which is smaller than the first opening value is selected as a target throttle valve opening in accordance with the operating condition of the engine, and the throttle valve is driven so that its opening becomes equal to the target throttle valve opening. Therefore, by setting the first opening value as the target valve opening in the power requiring range and setting the second opening value as the target throttle valve opening in the economical driving requiring range, it is possible to prevent a condition wherein the engine output power becomes insufficient in the power requiring range. Thus a good driveability of the engine is obtained. After switching of the target throttle valve opening from the second opening value to the first opening value, the driving of the throttle valve in the opening direction is enabled only when the operation position of the accelerator pedal is changed toward the depressing direction. Therefore, occurrence of a control state in which the opening of the throttle valve is increased suddenly contrary to the operation of the accelerator pedal can be prevented. Thus, the switching of the setting of the target throttle valve opening can be effected smoothly.

In the above described embodiments, the drive circuit 36 is arranged to generate a pulse signal for driving the pulse motor at a fixed drive speed nd to supply it to the pulse motor 12 in response to the pulse motor valve open drive command or the pulse motor valve close drive command from the CPU 37. However, it is also possible to adopt an arrangement wherein the CPU 37 generates a pulse motor valve open drive command or a pulse motor valve close drive command which indicates a number of pulses corresponding to the deviation of the actual throttle valve opening $\theta$th from the target throttle valve opening $\theta_N$ and the CPU 37 supplies it to the drive circuit 36, so that the drive circuit 36 supplies pulses the number of which is designated by the CPU 37, to the pulse motor 12. Also in such a case, the drive speed $\Delta\theta$thL upon transition from the economical driving requiring range to the power requiring range is smaller than the minimum value of the drive speed $\Delta\theta$thH in the economical driving requiring range with the operation of the first embodiment. Moreover an ordinary DC motor can be used in place of the pulse motor used in the above described embodiments.

In addition, it is to be noted that the throttle valve control apparatus according to the present invention is best suited for use with a device which determines the engine rotational speed in accordance with the operation position of the accelerator pedal and the range of the engine operation, such as a CVT (continuously variable transmission) system.

What is claimed is:

1. A throttle valve control apparatus for controlling the opening of a throttle valve disposed in an intake system of an internal combustion engine having an accelerator pedal and mounted on a vehicle, comprising:

accelerator pedal position detection means for detecting an operation position of said accelerator pedal;

target throttle valve opening setting means for setting a target opening of said throttle valve;

throttle valve opening detection means detecting the actual opening of said throttle valve;

throttle valve drive means for driving said throttle valve to equalize said actual opening of said throttle valve to said target throttle valve opening;

means for detecting an operating condition of said internal combustion engine, wherein one of a first opening value proportional to said operation position of said accelerator pedal and a second opening value which is smaller than said first opening value is selected by said target throttle valve opening setting means as said target throttle valve opening in accordance with said operating condition of said internal combustion engine; and means for limiting the driving speed of said throttle valve by said throttle valve drive means to be lower than a slow limit speed when said target throttle valve opening is switched from said second opening value to said first opening value.

2. A throttle valve control apparatus for controlling the opening of a throttle valve disposed in an intake system of an internal combustion engine having an accelerator pedal and mounted on a vehicle, comprising:

accelerator pedal position detection means for detecting an operation position of said accelerator pedal;

target throttle valve opening setting means for setting a target opening of said throttle valve;

throttle valve opening detection means for detecting the actual opening of said throttle valve;

throttle valve drive means for driving said throttle valve to equalize said actual opening of said throttle valve to said target throttle valve opening;

means for detecting an operating condition of said internal combustion engine wherein one of a first opening value proportional to said operation position of said accelerator pedal and a second opening value which is smaller than said first value is selected by said target throttle valve opening setting means as said target throttle valve opening in accordance with said operating condition of said internal combustion engine; and means for enabling the driving of said throttle valve by said throttle valve drive means only when said operation position of said accelerator pedal is changed in a depressing direction, after said target throttle valve opening is switched from said second opening value to said first opening value.

3. An apparatus as set forth in claim 2, wherein said throttle valve drive means increases the driving speed of said throttle valve in an opening direction in accordance with a speed of change in said operation position of said accelerator pedal, after said target throttle valve opening is switched from said second opening value to said first opening value.

4. An apparatus as set forth in claim 3, wherein said throttle valve drive means drive said throttle valve in an opening direction at a drive speed lower than speed values used when said throttle valve is driven with said second opening value being set as said target throttle valve opening, after said target throttle valve opening is switched from said second opening value to said first opening value.

* * * * *